United States Patent [19]

Griffiths et al.

[11] Patent Number: 4,861,292

[45] Date of Patent: Aug. 29, 1989

[54] SPEED OPTIMIZING POSITIONING SYSTEM FOR A MARINE DRIVE UNIT

[75] Inventors: John M. Griffiths; Wayne T. Beck, both of Fond du Lac; Neil A. Newman, Omro, all of Wis.

[73] Assignee: Brunswick Corporation, Skokie, Ill.

[21] Appl. No.: 218,686

[22] Filed: Jan. 38, 1988

[51] Int. Cl.[4] ..... B63H 5/06

[52] U.S. Cl. ..... 440/1; 440/53; 440/61

[58] Field of Search ..... 440/1, 2, 53, 61, 62, 440/63, 900, 113; 123/349, 351, 350; 364/424, 442; 73/178 T; 416/27; 318/588; 244/182, 191, 194; 114/275, 278, 276, 282; 180/170, 175, 176, 179

[56] References Cited

U.S. PATENT DOCUMENTS

| | | | |
|---|---|---|---|
| 2,782,744 | 6/1954 | Staley | 248/641 |
| 3,070,301 | 12/1962 | Sarnoff | 73/178 T |
| 3,216,522 | 11/1965 | Cassano | 180/179 |
| 3,468,282 | 9/1969 | Wintercorn | 440/53 |
| 3,921,751 | 11/1975 | Sakakibara et al. | 123/349 |
| 3,990,660 | 9/1976 | Pipoz | 248/642 |
| 4,013,249 | 3/1977 | Meyer et al. | 440/61 |
| 4,168,818 | 9/1979 | Ellis | 248/641 |
| 4,318,699 | 3/1982 | Wenstadt et al. | 440/1 |
| 4,673,358 | 6/1987 | Iwai et al. | 440/53 |
| 4,682,961 | 7/1987 | Nakahama | 440/53 |
| 4,718,872 | 1/1988 | Olson et al. | 440/1 |

FOREIGN PATENT DOCUMENTS

| | | | |
|---|---|---|---|
| 0012498 | 1/1986 | Japan | 440/1 |

*Primary Examiner*—Joseph F. Peters, Jr.
*Assistant Examiner*—Edwin L. Swinehart
*Attorney, Agent, or Firm*—Andrus, Sceales, Starke & Sawall

[57] ABSTRACT

A system for optimizing the speed of a boat at a paticular throttle setting utilizes sensed speed changes to vary the boat drive unit position vertically and to vary the drive unit trim position. The measurement of boat speed before and after an incremental change in vertical position or trim is used in conjunction with a selected minimum speed change increment to effect subsequent alternate control strategies. Depending on the relative difference in before and after speeds, the system will automatically continue incremental movement of the drive unit in the same direction, hold the drive unit in its present position, or move the drive unit an incremental amount in the opposite direction to its previous position. The alternate control strategies minimize the effects of initial incremental movement in the wrong direction, eliminate excessive position hunting by the system, and minimize drive unit repositioning which has little or no practical effect on speed.

17 Claims, 5 Drawing Sheets

SPEED OPTIMIZING POSITIONING SYSTEM FOR A MARINE DRIVE UNIT

BACKGROUND OF THE INVENTION

The present invention relates to a system for controlling the position of a marine drive unit and, more particularly, to a system for automatically positioning a drive unit to optimize speed at a given throttle setting.

The drive units for marine propulsion devices, including outboard motors and stern drives, are supported from the boat transom by a drive mounting assembly. Various types of drive mounting assemblies are known, as for example a transom bracket for mounting an outboard motor directly on a boat transom or a gimbal ring assembly for similarly mounting a stern drive unit directly to the transom. Typically, a drive unit mounted directly on the boat transom may be trimmed by pivoting it about a generally horizontal axis in order to position the propeller and optimize thrust with respect to the plane of the boat. However, the vertical position of the drive unit usually cannot be changed beyond the somewhat limited amount which inherently results from the trimming operation. Therefore, the drive unit must typically be mounted in a compromise position at a fixed height with respect to the transom which will provide the best performance. Another type of drive mounting assembly is one which is capable of selectively supporting an outboard motor in either a raised or a lowered position aft of the boat transom. Many of these transom extension types of mounting assemblies are of the general type which include a pivotally connected quadrilateral linkage, generally in the form of a parallelogram.

Transom extension mounting assemblies have become increasingly popular on high performance boats powered by outboard motors, such as bass boats, where a lower position of the motor improves initial boat acceleration and a higher position enhances top speed by reducing gear case drag. Additionally, a higher motor position reduces draft, thereby enhancing shallow water operation. It is further known that relocating the motor aft of the transom improves the handling characteristics of most boats at high speeds. These devices also allow the boat to be built with a higher transom for improved safety in following wave conditions, thereby allowing boat builders to manufacture a common hull and transom design for both outboard and stern drive applications.

Examples of transom extension mounting assemblies for outboard motors, which support the motor spaced from the boat transom, are disclosed in the following U.S. Pat. Nos.: 2,782,744; 3,990,660; 4,013,249; 4,168,818; 4,673,358; and 4,682,961. The first four of the foregoing patents disclose apparatus which is utilized to raise the motor vertically and the latter two patents describe apparatus which is utilized to trim the propeller and tilt the motor up and out of the water about a generally horizontal axis. In addition, U.S. patent applications Ser. No. 092,168, filed Sept. 2, 1987; Ser. No. 100,216, filed Sept. 23, 1987; Ser. No. 103,508, filed Oct. 1, 1987; Ser. No. 172,399, filed Mar. 24, 1988; and an application entitled "Combined Trim,. Tilt and Lift Apparatus for a Marine Propulsion Device" filed Apr. 14, 1988, all of which are assigned to the assignee of this application, disclose outboard motor transom extension mounting assemblies which utilize a quadrilateral linkage arrangement to raise and lower the motor with respect to the transom. The quadrilateral linkage comprises four pivotally connected links forming a collapsible linkage the movement of which effects vertical movement of the motor. Various of the foregoing copending applications disclose means for controlling the movement and positioning of transom extension mounting assemblies to avoid hazardous or undesirable operating conditions. The disclosed control systems operate automatically to lift or lower the motor with respect to the transom until the hazardous or undesirable operating condition is eliminated.

U.S. Pat. No. 4,318,699 discloses a system for automatically trimming a marine drive unit in response to a sensed operating condition, such as engine speed. A trimming operation involves tilting the drive unit about a horizontal axis to position the drive unit for on-plane and off-plane operation of the boat. The drive is typically trimmed out at high speeds and trimmed in at lower speeds. The system of the foregoing patent is automatically responsive to move the drive unit to preselected trim positions characteristic of the boat on which it is used.

U.S. Pat. No. 4,718,872 describes a system for automatically adjusting the trim of a marine drive unit by sensing an increase in boat speed and adjusting the trim until the boat speed ceases to increase. The automatic control system is operative to incrementally move the drive unit in one direction as long as the movement results in an increase in speed and then to move the drive unit in the opposite direction as long as the adjustment results in an increase in speed. The control system thus hunts for optimal adjustment by trimming the drive unit back and forth in both directions until maximum boat speed at a particular throttle setting is achieved. However, basing an automatic trim adjustment on the occurrence of any increase in speed (or the absence thereof) may result in excessive hunting by the system and trim changes based on small changes in speed which are too insignificant to make any practical difference. In addition, although proper trim control has a significant impact on speed optimization, vertical lifting and/or lowering of the drive unit can also significantly affect speed optimization. Furthermore, trim and lift drive systems in a boat are generally independent and manual adjustment of each of them by an operator to attain optimum speed is somewhat difficult and requires substantial skill.

It would be desirable, therefore, to have a system for automatically adjusting both trim and lift of a drive unit to attain optimum speed at a particular throttle setting. In addition, it would be desirable to have a system which is relatively immune from excessive hunting and position changes which do not have a practical effect on boat speed.

SUMMARY OF THE INVENTION

The present invention is directed to a system for optimizing boat speed by automatically positioning the drive unit. The system is based on the measurement and use of an incremental speed change upon which alternative control strategies are based and automatically implemented.

The control system is automatically operable to incrementally move the drive unit in one direction as long as each incremental movement results in an increase in speed in excess of a minimum incremental speed. If the incremental movement of the drive unit results in an increase in speed which is less than the minimum speed increment, the preceding incremental movement of the drive unit will be retained, but further incremental movement in the same direction is discontinued. If there is no increase in speed after an incremental movement, the control system will automatically cause an incremental movement of the drive unit in the opposition direction.

By applying the basic control strategy outlined above to effect a specific drive unit movement known to generally result in an increase in speed, substantial optimization may be achieved at that basic level. For example, raising an outboard motor vertically generally results in an increase in speed and, therefore, raising the motor in vertical increments is a preferred first stage optimization strategy. In its preferred basic form, the control system strategy, which may be implemented with the use of a microprocessor, includes the steps of storing the boat speed prior to raising the engine one increment as the "before speed", raising or lifting the engine one increment, pausing for a short time to allow the boat speed to stabilize, obtaining the boat speed after the incremental lift as the "after speed", comparing the before speed and after speed and, alternatively, repeating the cycle to lift the engine another increment if the after speed is greater than the before speed by an amount in excess of the minimum speed increment, temporarily discontinuing the incremental lifting of the drive unit if the after speed is greater than the before speed by an amount less than the speed increment, or lowering the engine by an incremental amount if the after speed is not greater than the before speed. If the lift cycle is repeated at least once, pursuant to the first alternative step, the subsequent occurrence of either the second or third alternative step will effect termination of the optimization process. However, if either of alternative steps 2 or 3 takes place before an additional lift increment is effected pursuant to alternative step 1, the system preferably moves to a supplemental or second stage strategy similar to the first level strategy, except that it is based on incremental movement :n the opposition direction (vertical downward movement in this example).

Thus, the second level control system strategy operates according to the steps of utilizing the current boat speed as the "before speed", lowering the engine one increment, pausing to allow the boat speed to stabilize, utilizing the boat speed after the incremental lowering as the "after speed", comparing the before and after speeds, and, alternatively, repeating the cycle to lower the engine another incremental amount if the after speed is greater than the before speed by an amount in excess of the minimum speed increment, temporarily discontinuing the incremental lowering if the after speed is greater than the before speed by an amount less than the minimum speed increment, or raising the engine by an incremental amount if the after speed is not greater than the before speed.

The basic control strategy of the present invention can be applied to a trim system, as well as a lift system, or the two may be combined in a single system to optimize speed based on the control of both the lift system and the trim system. In one embodiment, speed is first optimized by adjusting the lift, in a manner previously described, further speed optimization is provided by adjusting the trim system in a similar manner, and the entire two system adjustment process may be automatically repeated for any desired number of passes. In another embodiment, speed is optimized by successively adjusting the lift and trim, utilizing large incremental amounts of movement, and then performing the optimization again utilizing smaller increments of lift and trim. This embodiment may use a single or multiple passes or cycles.

DETAILED DESCRIPTION OF THE PREFERRED EMBODIMENT

Figure 1:
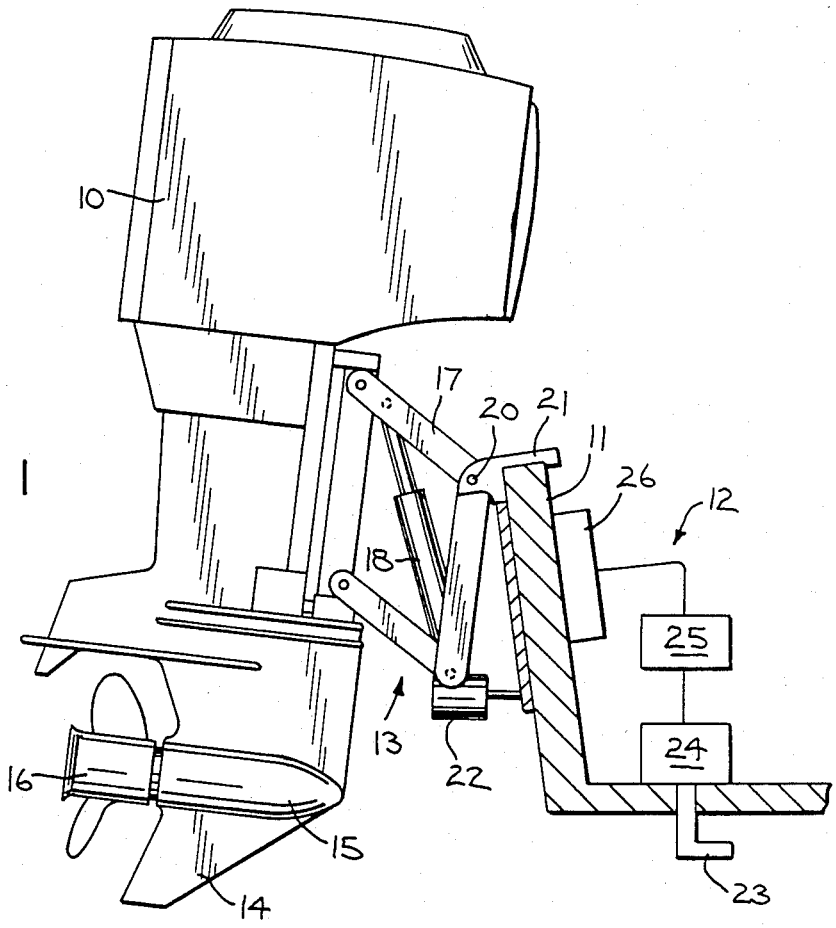
FIG. 1 is a side elevation of an outboard motor attached to a boat by means of a transom extension assembly which includes apparatus for lifting and for trimming the motor with respect to the boat.
Figure 2:
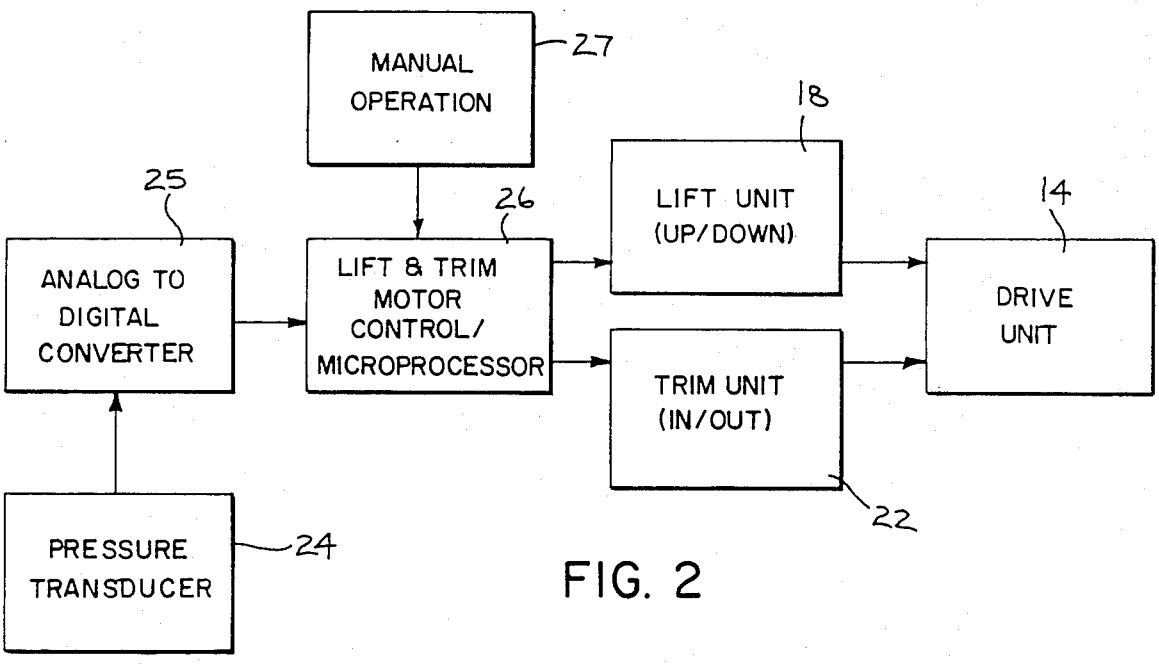
FIG. 2 is a block diagram of the control system of the present invention.

In FIG. 1, an outboard motor 10 is mounted to the transom 11 of a boat 12 with a transom extension mounting assembly 13. The mounting assembly 13 positions the motor 10 aft of the transom and is adapted to provide vertical movement to lift or lower the motor with respect to the boat and to provide trim movement for limited tilting of the motor about a horizontal axis to vary the angle of the propulsive thrust vector with respect to the horizontal.

The outboard motor 10 includes the usual lower drive unit 14, including a gear case 15 and propeller 16. The transom extension mounting assembly 13 includes a pivotally connected quadrilateral linkage 17, opposite sides of which are interconnected by a lift cylinder 18. Extension of the lift cylinder causes the linkage 17 to collapse and the outboard motor 10 to be lifted vertically. Conversely, retraction of the lift cylinder 18 results in vertical lowering movement of the motor. The mounting assembly 13 is pivotally attached at its upper end to the upper end of a transom bracket 21 by a tilt pivot 20. A trim cylinder 22 (or cylinders) is attached to the lower end of the mounting assembly 13 and extension of the cylinder causes pivotal trimming movement of the mounting assembly and attached outboard motor about the tilt pivot 20 to vary the thrust vector of the drive unit 14.

The hydraulic pump, motor and reservoir for hydraulic fluid to operate the lift cylinder 18 and trim cylinder 22 may be mounted on the extension mounting assembly 13, in which case only electric power to operate the motor need be supplied to the assembly. Alternately, the pump, motor and reservoir may be mounted within the boat with appropriate hydraulic lines attached to the lift and trim cylinders. The lift and trim cylinders may each have an independent hydraulic system, including a separate motor, pump and reservoir, or, with appropriate valving and controls, the lift and trim cylinders may share a common motor, pump and reservoir.

Boat speed which is a primary control function in the system of the present invention is measured by the usual combination of a pitot tube 23 and pressure transducer 24. The analog speed signal from the pressure transducer is fed to an analog to digital converter 25 to provide an input signal to the lift and trim motor control 26 which includes a programmed microprocessor.

The system includes a manual operation control 27 which overrides the automatic microprocessor control 26 to allow conventional manual operation of either the lift system or the trim system. The manual control 27 also includes an optimizing button 28 allowing the boat operator to enter the optimizing system to be hereinafter described.

Figure 3:
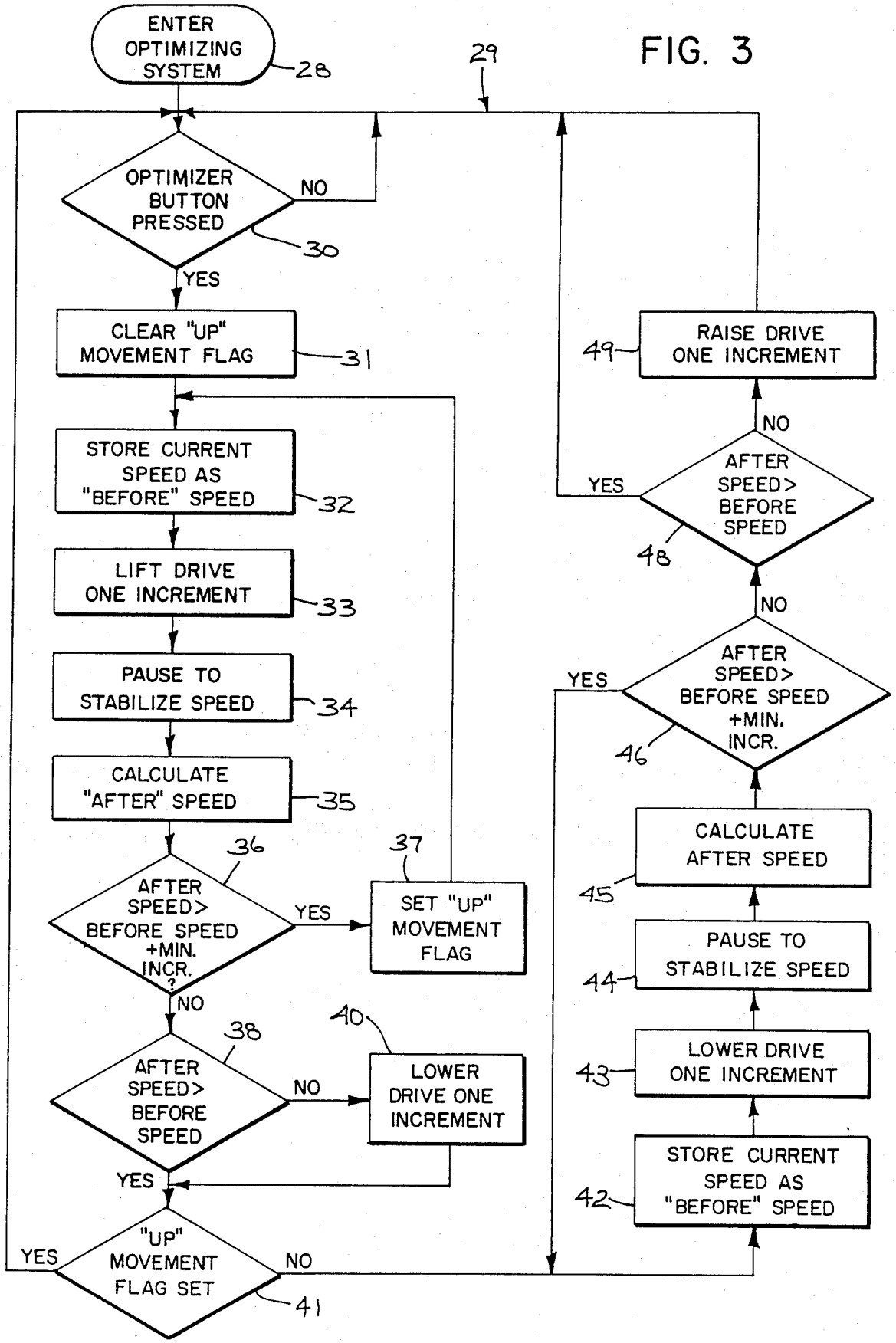
FIG. 3 is a logic diagram showing operation of a basic element of the optimization system based on lift control.

FIG. 3 shows an optimizing system 29 of the present invention operating on the basis of lift control only. Entry into the optimizing circuit at 28 keys the activation decision step 30 to clear the "up" movement flag at process step 31 to effectively zero the system. At process step 32, the current boat speed is stored as the "before" speed value. "Before" is in reference to movement of the drive unit, in this case vertical movement. At the lift process step 33, the motor 10 including the drive unit 14 is lifted vertically one increment. The incremental movement is based on a time signal programmed into the microprocessor. For example, operating the lift unit 18 for a period of one second might typically result in vertical movement of one inch. After the initial incremental lift, the system pauses at process step 34 to allow the boat speed to stabilize. At process step 35 the "after" speed is calculated. As with the "before" speed, the "after" speed is in reference to the incremental movement of the drive unit (in this case vertical lifting movement).

The before and after speed signals are then compared at decision step 36 to determine if the after speed is greater than the before speed by an amount in excess of a minimum speed increment. The use of a minimum speed increment takes into account inevitable fluctuations which will occur in the speedometer readings, avoids excessive "hunting" by the system as a result thereof, and precludes drive unit position changes as a result of speed changes that are too insignificant to make any different in performance. The incremental speed may, for example, be selected as ½ mph, or a smaller or larger increment, depending on the sensitivity desired.

If the after speed, calculated at decision step 36, is greater than the before speed by an amount in excess of the minimum incremental speed, the system operates at process step 37 to set an "up" or lift movement flag. The signal is stored for subsequent use, as will be hereinafter described. From process step 37 the system cycles back to process step 32 where the current or existing after speed becomes the next before speed and the system causes the drive to be lifted one more increment at 33, pauses for speed stabilization at 34, calculates a new after speed at 35, and again compares before and after speeds at decision step 36. The preceding cycle repeats as long as the after speed exceeds the before speed by an amount greater than a minimum incremental speed.

If the after sped does not exceed the before speed by an amount greater than the minimum incremental speed, a determination is made at decision step 38 whether or not the after speed is greater than the before speed (though by an amount less than the minimum increment). If there is a speed increase, the system moves to next decision step. However, if no increase in speed is sensed at decision step 38, the lift cylinder 18 is automatically activated to retract and lower the drive unit one increment at process step 40. Lowering the drive unit at process step 40 is effected because the previous lift movement at process step 33 did not result in a speed increase and may possibly even have resulted in a decrease in speed. Even if the before and after speeds at decision step 38 are equal, the drive unit will automatically be lowered one increment to reestablish its previous position, because a lower drive position generally provides a better thrust characteristic and somewhat improved performance. In addition, a lower drive unit position helps assure that the cooling water pick up ports are below the water line.

From a "yes" output at decision step 38 or from process step 40, the system moves to decision step 41 where it is determined whether or not the up movement flag was set at process step 37. In other words, it is determined whether or not the speed comparison at decision step 36 resulted in at least one additional cycle of incremental lift to the drive unit. If the up movement flag has been set, the system will automatically deactivate. Alternatively and as will be described in more detail below, if the up movement flag has not been set, the output from decision step 41 may be utilized to initiate another level of optimization or to enter the system into another control strategy routine. Utilizing the up movement flag in the control strategy just described provides assurance that incrementally lifting the drive unit was the proper direction toward optimizing speed and that a basic level of optimization has been achieved. In other words, if the after speed resulting from the initial incremental lift at step 33 is not greater than the before speed by the minimum incremental speed, it is assumed that the initial lift was in the wrong direction for optimization.

If the up movement flag has not been set, the output from decision step 41 proceeds to a second routine similar to that just described, but based on incremental lowering of the drive unit. Thus, at process step 42 the current boat speed is stored as the existing before speed. The drive is then lowered one increment at process step 43 and, at process step 44, the system again pauses to allow the boat speed to stabilize. At process step 45, the after speed resulting from lowering the drive unit at 43 is calculated. The latest before and after speeds are compared and, at decision step 46, the output depends on whether or not the after speed is in excess of the before speed by an amount greater than the minimum incremental speed, in a manner identical to decision step 36 previously described. If it is, the system recycles back to process step 42 and the drive is lowered one more increment. When the increase in after speed over before speed is not in excess of the minimum incremental amount, the system moves to decision step 48 where it is determined whether or not the after speed exceeds the before speed by any amount. If it does, optimization of speed at this particular level is considered to have been attained and the output signal is utilized to deactivate the system, as shown, or alternately to continue into another level of control strategy or another control routine. If the after speed is not greater than the before speed, the output is processed at step 49 to raise the drive unit one increment. The output from process step 49 proceeds in the same manner as described for the affirmative output from decision step 48.

It should be noted that, because the system has already been checked to determine if initial lift movement of the drive unit was the proper direction for optimization (by utilization of the up movement flag at process step 37 and decision step 41), a similar flagging of down movement is not required in the subroutine just described.

As previously indicated, the system of the present invention may also be based on trim control or on a combination of lift control and trim control. Numerous other variations can be incorporated into either system, some of which will be described hereinafter.

Figure 4:
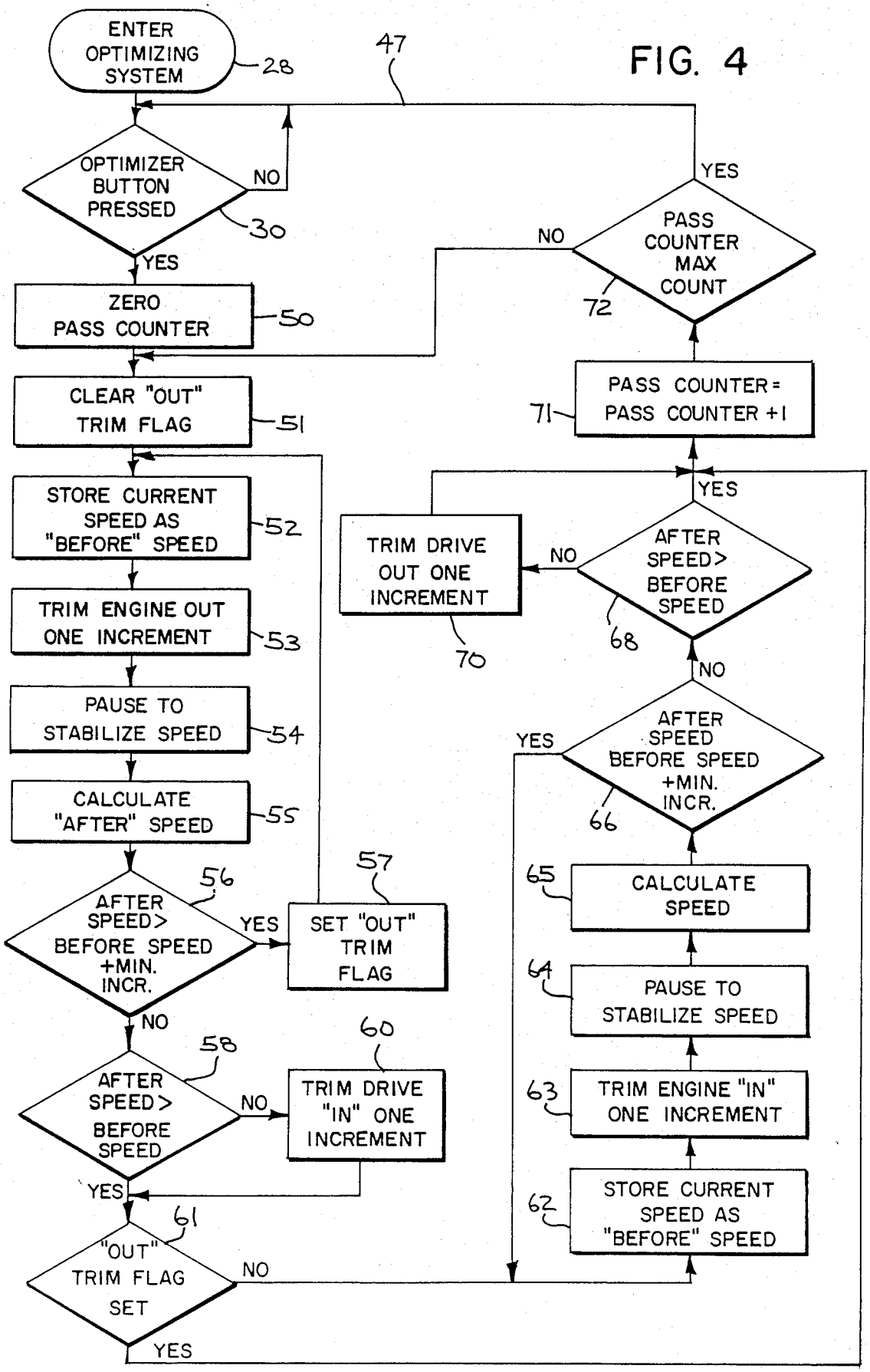
FIG. 4 is a logic diagram similar to FIG. 3 showing operation of a system based on trim control.

The logic diagram of FIG. 4 shows a speed optimization system based on trim control which system is similar to the lift control system of FIG. 3. As indicated, this system may be operated independently or may be combined with a lift control system to provide a high level of optimization by automatic sequential control of lift and trim. The system of FIG. 4 may be manually activated in the same manner as the previously described system by pushing the optimizing button 28 and activating the system at decision step 30. At process step 50, the pass counter, which keeps track of the number of repeat cycles through the system, is zeroed. It is understood, of course, that optimization may be attained with one complete system cycle and the past counter may, therefore, be eliminated. Next, the trim out flag is cleared at process step 51 and the current boat speed is stored as the "before" speed at process step 52. The control 26 is then activated at process step 53 to cause the trim cylinder 22 to be extended and to trim the engine out one increment. The incremental trim movement is based on a time signal, as was the lift increment previously described, and a one second movement may change the trim angle by, for example, 2°. The system then pauses at process step 54 for a time sufficient to allow the boat speed to stabilize, and the after speed resulting from the incremental trimming out is calculated at process step 55. The before and after speeds are compared and, at decision step 56, it is determined if the after speed is greater than the before speed by an amount in excess of a minimum speed increment. The speed increment may conveniently be the same as that used in the lift control routine or another speed increment may be utilized. If the after speed is greater by an amount in excess of the minimum increment, the out trim flag is set at process step 57 and the previously calculated after speed from process step 55 is stored at process step 52 as the current before speed. The system again proceeds through process steps 53, 54 and 55 to trim the drive unit out an additional increment, pause to allow boat speed to stabilize, and calculate the current after speed, respectively. As long as the after speed continues to exceed the before speed by an amount greater than the minimum incremental speed, the process will cycle through steps 52–57 and the drive unit will be trimmed out one additional increment with each cycle.

When the appropriate speed increase is no longer detected at decision step 56, a determination is made, at decision step 58 whether or not the after speed is greater than the before speed. If it is, no change is effected. If it is not (i.e. the after speed is equal to or less than the before speed), the drive unit is trimmed in one increment at process step 60.

The out trim flag is then checked to see if it was set at process step 57 and, if it was, optimization based on the trim control routine is considered to have been completed and further trim adjustments are bypassed. If the out trim flag was not set (only one pass was made through process step 53 to trim the drive unit out one increment), the process continues to process step 62 where the current or last measured speed is stored as the before speed. The drive unit is then trimmed in one increment at process step 63. The reasoning for process step 63 is the same as that used in establishing process step 43 in the FIG. 3 control routine, namely, an absence of setting the out trim flag (step 57) suggests the possibility that initially trimming the drive unit out at process step 53 may actually have moved the unit away from the optimum position. Thus, the drive unit is either brought back to its original trim position prior to initiating optimization or, if the drive unit has already trimmed back one increment at process step 60, the drive will be trimmed in another increment at step 63. Process steps 64 and 65 provide time to stabilize boat speed and to calculate the latest after speed, respectively.

The determination is then made, at decision step 66, whether or not the trim in increment at 63 resulted in an after speed which is greater than the before speed by an amount in excess of the minimum speed increment. If "yes", the process recycles through steps 62–66 in a manner previously described, but without a decision step to set a trim flag as in step 57. If "no", decision step 68 determines if the after speed is greater than the before speed and, if it is, the optimization cycle is considered complete and the process exits to the pass counter incrementing process step 71. If at decision step 68 the after speed is not greater than the before speed, the drive unit is automatically trimmed out one increment at process step 70 from which the process continues to the pass counter incrementing process step 71.

The input to process step 71, which may be from decision steps 61 or 68 or process step 70, all indicative of the completion of one optimization cycle, causes the pass counter to increment by one and the total count is read at decision step 72 to determine if the pass counter total is greater than the maximum count programmed into the microprocessor. Thus, the control routine just described is designed to recycle through the optimization routine a number of times equal to the programmed pass count plus one. For example, if the program pass count were one, the system would automatically run two optimization cycles. Recycling through the optimization process provides a higher degree of optimization, but a single pass through the optimization routine, whether based on trim adjustment alone or incorporating a similar routine based on lift adjustment, may be adequate in many situations. If the pass counter at decision step 72 is at the set limit, the system is automatically deactivated. If the count has not reached the set limit, the system is reset and the process reentered between process steps 49 and 51 where the latter step causes the trim out flag to be cleared and the process to begin again.

Figure 5:
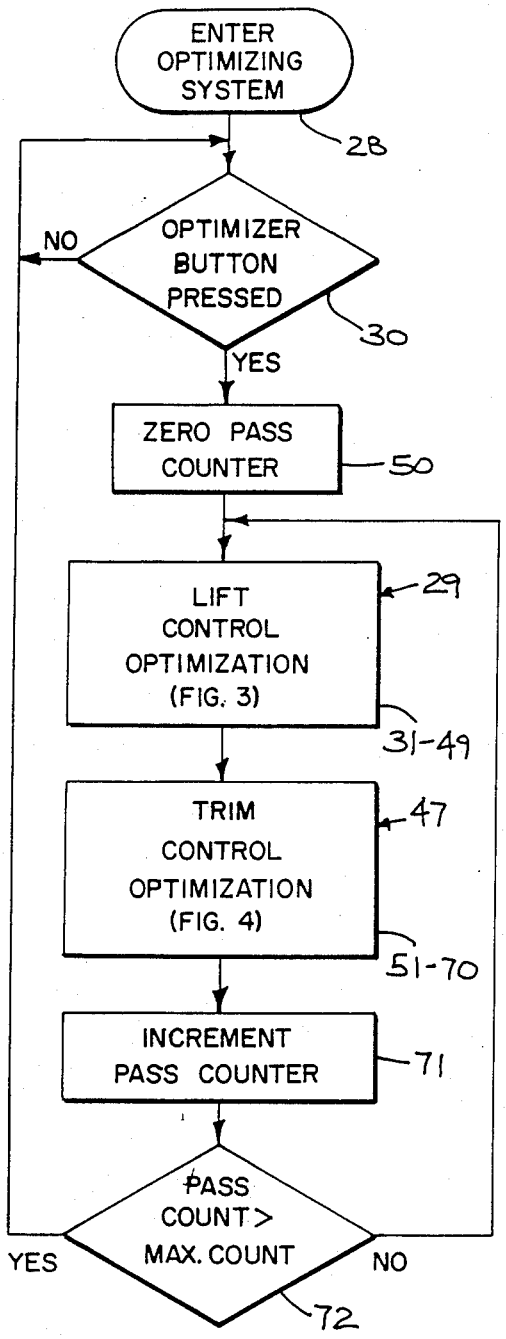
FIG. 5 is a generalized logic diagram showing one embodiment of an optimization system of the present invention utilizing both lift and trim control.

FIG. 5 is a more generalized diagram showing a logical combination of the optimization systems of FIGS. 3 and 4. The combined optimization system is entered at 28 by pressing the optimizing button. The corresponding "yes" response at decision step 30 results in zeroing of the pass counter at process step 49. The optimization routine based on lift control is entered at process step 31 of FIG. 3 and continues through process step 50 (unless earlier exit from the routine occurs), where the process continues into the optimization routine based on trim control of FIG. 4, including steps 51 through 70. At process step 71 the pass counter is incremented by one and at subsequent decision step 72 it is determined if the pass count exceeds the preset maximum count. If it does the system is automatically deactivated and, if it does not, the system is set to recycle by reentry at process step 31.

Figure 6:
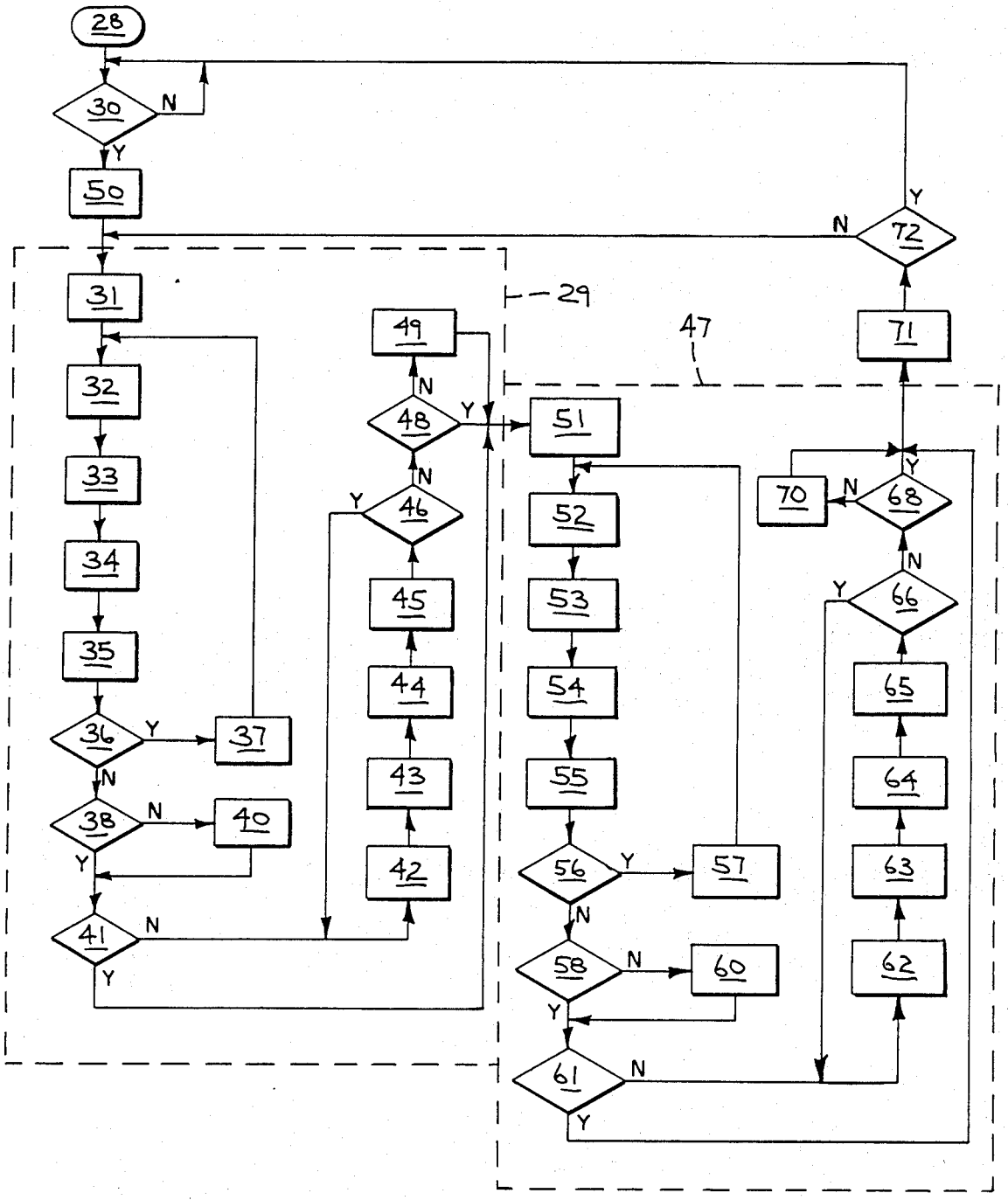
FIG. 6 is a detailed logic diagram of the optimization system of FIG. 5.

The detailed logic diagram of FIG. 6 shows exactly how the optimization systems of FIGS. 3 and 4 are combined, as shown generally in FIG. 5, including the details of those changes in the FIG. 3 and 4 logic necessitated by the combination. To convert the speed optimization lift control system 29 of FIG. 3 from independent operation and combine it with the speed optimization system 47 based on trim control of FIG. 4, the logic "yes" output from decision step 41, the logic "yes" output from decision step 48 and the logic output from process step 49 proceed to process step 51 in the trim control system 47 of FIG. 4. The operation of the lift control system 29, shown in dashed lines in FIG. 6, is otherwise unchanged and corresponds to the generalized representation of the system 29 in FIG. 5. The basic operation of the optimization system 47 based on trim control is, likewise, essentially unchanged from the FIG. 4 embodiment. The dashed line box 47 encloses that portion of the system and corresponds to the generalized representation of the system 47 in FIG. 5.

To utilize the system of FIG. 6, a boat operator would typically bring the boat to a selected cruising speed by manual operation of the controls and then press the optimizing button 28. The system then automatically proceeds to adjust the vertical position of the drive unit pursuant to subsystem 29. When speed is optimized with respect to vertical position of the drive unit, the system automatically proceeds to subsystem 47 where the trim (horizontal thrust vector) of the drive unit is adjusted automatically to attain maximum speed for the throttle setting. When the pass counter at process step 71 has been incremented such that the total count is one greater than the maximum pass count programmed into the microprocessor, the logic process exits at decision step 72 to automatically deactivate the system. It is possible, however, to attain a substantial degree of speed optimization by utilizing the combined system of FIG. 6 without recycling through the use of a pass counter. In that case process steps 50 and 71 and decision step 72 are simply eliminated, and the logic output from subsystem 47 proceeds to decision step 30 to deactivate the system.

Figure 7:
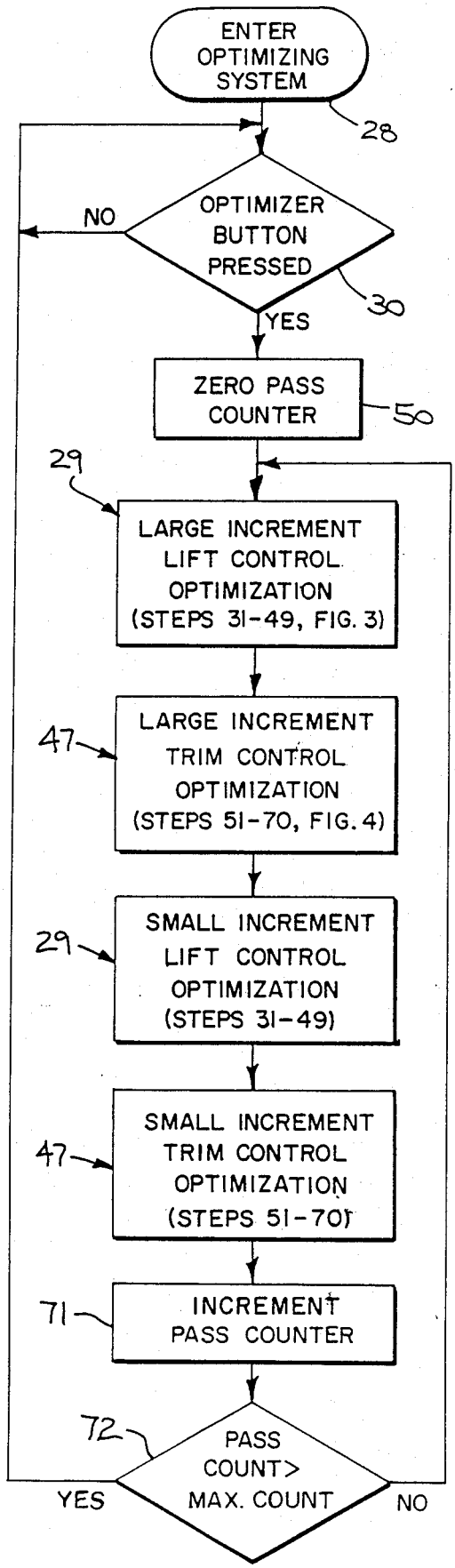
FIG. 7 is a generalized block diagram similar to FIG. 5 showing another embodiment of the invention.

An additional level of sophistication and a corresponding high level of speed optimization may be attained with the system embodiment shown in FIG. 7. The system of FIG. 7 is very similar to that shown in FIGS. 5 and 6, except that an additional optimization routine for both lift control and trim control, utilizing a smaller increment of drive unit movement, is added to the system. Thus, the system is designed to first proceed sequentially through subsystems 29 and 47 in the manner shown in FIG. 5 and then, utilizing increments of vertical lift movement and trim movement somewhat smaller (e.g. ½) than used initially, to sequentially repeat the subsystem routines 29 and 47. This expanded system may utilize a pass counter, but the level of speed optimization obtained with one complete cycle of the system is generally adequate and the pass counter may, therefore, be eliminated. In addition to using smaller increments of lift and trim movement in repeating the subsystem routines 29 and 47, the minimum speed increment, utilized in decision steps 36 and 46 of the lift subsystem 29 and in decision steps 56 and 66 of the trim subsystem 47, may also be decreased. Other variations, such as elimination of one or the other of the small increment subsystems, may also be made.

Various modes of carrying out the invention are contemplated as being within the scope of the following claims particularly pointing out and distinctly claiming the subject matter which is regarded as the invention.

We claim:

1. A system for positioning a marine drive unit with respect to a boat on which it is mounted to optimize boat speed comprising:

means for moving the drive unit relative to the boat;

means for sensing the boat speed and for providing an output signal indicative of the boat speed;

control means operative to cause the moving means to impart a first incremental movement in one direction to the drive unit and to compare the output signals of speed before and after said first incremental movement, said control means being selectively responsive to a first signal indicative of an after speed greater than the before speed by an amount in excess of a first incremental speed, a second signal indicative of an after speed greater than the before speed by an amount less than said first incremental speed, and a third signal indicative of an after speed not greater than the before speed, to cause the moving means, respectively, to continue said first incremental movement of the drive unit in the same direction, to discontinue said first incremental movement of the drive unit, and to impart a first incremental movement to the drive unit in the opposite direction.

2. The system as set forth in claim 1 wherein the second signal is effective to cause response by the control means after the output of at least one first signal.

3. The system as defined in claim 1 wherein the output of said second signal before the output of a first signal is effective to cause the moving means to impart a first incremental movement to the drive unit in the opposite direction.

4. The system as defined in claim 3 wherein the output of said third signal before the output of a first signal is effective to cause the moving means to impart an additional first incremental movement to the drive unit in said opposite direction.

5. The system as defined in claim 4 wherein the output of said third signal after the output of at least one first signal is effective to terminate further first incremental movement.

6. The system as defined in claim 4 wherein said control means is further operative to compare the output signals of speed before and after one of said first incremental movement in the opposite direction resulting from said second signal output and said additional first incremental movement in the opposite direction, and to generate additional first, second and third signals to cause the moving means, respectively, to continue said first incremental movement of the drive unit in the opposite direction, to discontinue said first incremental movement and to impart a first incremental movement to the drive unit in said one direction.

7. The system as defined in claim 6 wherein said means for moving the drive unit comprises a lift apparatus and said first incremental movement is in a generally vertical direction.

8. The system as defined in claim 7 wherein said vertical movement is upward.

9. The system as defined in claim 8 wherein said means for moving the drive unit further comprises a trim apparatus, and said control means is operative to cause the trim apparatus to impart an incremental trim movement in one direction to the drive unit and to compare the output signals of speed before and after said incremental trim movement, said control means being selectively responsive to a first trim signal indicative of an after speed greater than the before speed by an amount in excess of a second incremental speed, a second trim signal indicative of an after speed greater than the before speed by an amount less than said second incremental speed, and a third trim signal indicative of an after speed not greater than the before speed, to cause the trim apparatus, respectively, to continue said incremental trim movement in the same direction, to discontinue said incremental trim movement, and to impart an incremental trim movement to the drive unit in the opposite direction.

10. The apparatus as defined in claim 9 wherein the control means is further responsive to one of said second and third trim signals in the absence of said first trim signal to cause the trim apparatus to impart an incremental trim movement to the drive unit in the opposite direction.

11. The system as defined in claim 9 wherein the output of said third trim signal before the output of a first trim signal is effective to cause the trim apparatus to impart an additional incremental trim movement to the drive unit in said opposite direction.

12. The system as defined in claim 11 wherein the output of said third trim signal after the output of at least one first trim signal is effective to terminate further incremental trim movement.

13. The system as defined in claim 12 wherein said control means is further operative to compare the output signals of speed before and after one of said incremental trim movement in the opposite direction resulting from said second trim signal output and said additional incremental trim movement in the opposite direction, and to generate additional first, second and third trim signals to cause the trim apparatus, respectively, to continue said incremental trim movement in the opposite direction, to discontinue said incremental trim movement, and to impart an incremental trim movement to the drive unit in said one direction.

14. The system as defined in claim 13 wherein said first and second incremental speeds are equal.

15. The system as defined in claim 13 wherein said control means is further operative to automatically recycle after response to one of the set of said additional first, second and third signals and the set of said additional first, second and third trim signals.

16. The system as defined in claim 15 including counter means operative to limit the automatic recycling to a selected number of cycles.

17. The system as defined in claim 15 wherein the control means is operative to decrease the magnitude of said first incremental movement and said incremental trim movement prior to recycle.

* * * * *